United States Patent [19]

Robb et al.

[11] 4,190,450

[45] Feb. 26, 1980

[54] CERAMIC CORES FOR MANUFACTURING HOLLOW METAL CASTINGS

[75] Inventors: Ronald R. Robb, Dover; Charles Yaker, Summit; Lamar Burd, Andover, all of N.J.

[73] Assignee: Howmet Turbine Components Corporation, Muskegon, Mich.

[21] Appl. No.: 742,593

[22] Filed: Nov. 17, 1976

[51] Int. Cl.[2] ..... B28B 7/34

[52] U.S. Cl. ..... 106/38.9; 106/38.35; 106/65; 106/69; 106/73.4; 106/73.5; 164/43; 260/375 B

[58] Field of Search ..... 106/38.3, 38.35, 38.9, 106/65, 69, 73.4, 73.5; 164/43

[56] References Cited

U.S. PATENT DOCUMENTS

| | | | |
|---|---|---|---|
| 1,932,202 | 10/1933 | Coleman et al. | 106/38.3 |
| 2,072,212 | 3/1937 | Moosdorf et al. | 106/38.9 |
| 2,211,133 | 8/1940 | Krosta | 106/38.9 |
| 2,251,610 | 8/1941 | Rost-Grande | 106/38.3 |
| 2,283,611 | 5/1942 | Neiman | 106/38.3 |
| 2,479,504 | 8/1949 | Moore et al. | 106/38.3 |
| 3,230,102 | 1/1966 | Miller | 106/68 |
| 3,234,607 | 2/1966 | Hammarlund | 106/38.3 |
| 3,303,030 | 2/1967 | Preston | 106/38.3 |

*Primary Examiner*—Lorenzo B. Hayes

*Attorney, Agent, or Firm*—McDougall, Hersh & Scott

[57] ABSTRACT

Cores for use in the casting of hollow metal parts by directional solidification from temperatures which may exceed 2700° F., in which the strength, dimensional stability and shape of the core is maintained at such high temperatures by formulating the core to contain Cristobalite in an amount of at least 2.5% by weight.

2 Claims, No Drawings

CERAMIC CORES FOR MANUFACTURING HOLLOW METAL CASTINGS

This invention relates to ceramic cores for use in the casting of hollow articles of intricate shapes, such as blades and vanes used in gas turbine engines for aircraft applications.

In the power plants for missiles, turbine drives and aircraft engines, use is made of blades, vanes, and other structural parts that are required to withstand extremely high temperature, under extremely corrosive conditions.

In order to combat these problems of high heat and corrosion, such power plants have been designed to make use of high melting point metals, such as titanium, zirconium and super alloys. The temperature encountered in some of the newer aircraft and turbine equipment has placed new demands upon such elements for most efficient utilization. To overcome these problems, further design modifications have been made, particularly in turbine blade construction. In such devices, it is now common practice to provide a series of internal cooling vents or channels to enable an amount of cooling to be effected by the flow of air or other fluid coolant therethrough.

Air cooled structures of the type described, particularly turbine components of high melting point metals, have been manufactured by the precision casting technique, using shell molds, as described in the Operhall U.S. Pat. No. 2,961,751.

Such vents or channels are provided in the casting by the use of cores which are fabricated into the disposable pattern for retention in the mold space after the pattern material has been removed so as to occupy the space for the vent or channel in the casting formed upon the introduction of molten metal into the mold space. The core is subsequently removed from the metal casting, as by solution in caustic, to leave the vent or channel in the desired location and arrangement in the final metal casting.

These cores must maintain their shape and dimensions throughout the process in order to produce an accurate internal contoured vent or channel in the casting. In high quality castings, such as are used in the gas turbine engine for aircraft application, the need for dimensional stability of the ceramic core is underscored by the fact that the metal wall thickness of such castings may be as low as 0.015". It will be recognized that any distortion of the ceramic core, prior to solidification of the metal cast into the mold cavity, will result in an inconsistency in the dimensions and/or contour of the casting cavity, resulting in unsatisfactory castings with corresponding high rejection rate.

Present core compositions involve the use of fused silica as a major constituent. This is done purposely so that it will be possible chemically to remove the core from the casting cavity by means of sodium or potassium hydroxide solutions. Leachability is an important factor in the investment casting of intricately cored blades and vanes.

Various techniques have been devised to facilitate the use of such core compositions, such as described in U.S. Pat. No. 3,957,715, the disclosure of which is incorporated herein by reference for compositions and techniques which may be employed in the preparation of castings in accordance with the practice of this invention.

Since the ceramic core is affected by its thermal history, it will be apparent that a core composition that is acceptable for mold temperatures normally used in the equiaxed process for the manufacture of precision cast parts, which temperatures are in the region of 2000° to 2100° F., may not be acceptable when the mold temperature is increased to 2700° F. and higher for use in the preparation of high strength cast parts by the process of directional solidification. It has been found that ceramic cores of current manufacture are not suitable for use at these higher temperatures. When used in the directionally solidified process for the production of high strength castings, distortions take place, resulting in castings with inconsistent and out-of-specification wall thickness.

Thus the rejection rate is rather high. This becomes a serious factor when consideration is given to the high cost of materials and the large investments that are made in the production of the directionally solidified precision cast parts.

It is an object of this invention materially to reduce the rejection rate of cast metal parts by providing cores that have greater stability at the highr temperatures thereby to increase the yield of castings within blueprint tolerances and lower rejection rates with marked improvement in the economies of the casting process.

While the invention will be described with reference to the production and composition of ceramic cores for use at the higher temperatures characteristic of the directional solidification process for casting metal parts, it will be understood that such ceramic cores will find beneficial use in the casting of hollow metal articles by the equiaxed process.

It has been found, in accordance with the practice of this invention, that ceramic cores having the desired thermal stability at temperatures as high as 2700° F. and above can be produced when the ceramic core composition is formulated to replace all or at least part of the silica component with a crystalline phase of silica which may be identified as Cristobalite. When present as a constituent of the ceramic core composition in an amount greater than 2.5% by weight, the high temperature stability of the ceramic core is superior to that of a core in which the silica component is formed of amorphous fused silica or fused silica combinations with zircon and/or alumina as the ceramic component of the core.

The amount of Cristobalite in the core body, at the time that the molten metal is cast into the mold cavity, is important. The quantity must be sufficient to achieve the desired improvement in high temperature stability without adversely affecting the strength of the core or the thermal shock properties. While beneficial use is obtained when all of the silica is replaced with Cristobalite, it is desirable to limit the maximum concentration in the fired core to about 35% by weight while it is preferred to have 5–20% by weight Cristobalite in the fired core. The remainder of the core can be formulated in the conventional manner of fused silica or fused silica and zircon, or fused silica, zircon and/or alumina, with conventional binders such as organo silicone resins, as described in the aforementioned U.S. Pat. No. 3,957,715. The presence of Cristobalite can be achieved by the direct addition of Cristobalite to the components making up the core composition. For this purpose, it is desirable to make use of Cristobalite in finely divided form such as in the range of −70 to −325 mesh. The core can be formed by transfer molding technique using silicone resins as the binder.

Having described the basic concepts of the invention, illustration will now be made by way of the following examples in which the ingredients are given in parts by weight:

EXAMPLES 1 TO 3

| Ingredients | Current | Ex. 1 Broad range | Ex. 2 Narrow range | Ex. 3 Specific Composition |
|---|---|---|---|---|
| Fused silica | 57.3 | 40–50 | 40–50 | 50 |
| Cristobalite | — | 2.5–35 | 5–20 | 7.5 |
| Zircon flour | 23.9 | 29 39 | 20–30 | 24 |
| Silicone resin | 17.9 | 10–20 | 10–20 | 19 |

The above compositions include additional ingredients such as calcium stearate as a lubricant, and a catalyst which may be in the form of finely divided magnesium oxide and benzoic acid in equal parts by weight, with the lubricant being present in an amount within the range of 0.2–2% by weight and the catalyst being present in an amount within the range of 0.2–2% by weight.

Procedure:

The foregoing compositions are formed into the desired core configuration by transfer molding. Thereafter, the preformed core is heated to a temperature of about 350° F. for from 3 to 10 minutes to cure the resin and then the core is heated to temperatures which are increased at a rate of 50°–100° F. per hour until the temperature of the core reaches 1200° F. The core is maintained at this temperature for about 4 hours. The core is then heated at a rate of 100° F. per hour until the temperature reaches 2050° F. and it is maintained at this temperature to complete the baking and firing cycle and to convert the resin to a siliceous material which functions as a binder to secure the ceramic particles together.

After cooling to room temperature, the finished core is used in the preparation of a shell mold, as by the procedure described in U.S. Pat. No. 2,961,751. Cores produced in the manner described are embedded in an expendable wax or plastic pattern and a ceramic mold is formed over the pattern. Thereafter, the wax or plastic is removed to leave at least the ends of the cores fixed in the walls of the shell mold whereby the cores are maintained in the desired positions within the cavity. Molten metal is poured into the shell molds whereby the cores provide the desired cored arrangement for the finished casting. The cores are removed by solution in sodium or potassium hydroxide.

For procedures wherein use is made of higher temperatures in the casting of the molten metal and controlled slow cooling from one direction, for directional solidification in the fabrication of high strength cast parts, reference can be made to the copending application Ser. No. 643,167, filed on Dec. 22, 1975, now U.S. Pat. No. 4,062,399, by Nick G. Lirones, and entitled "System for Producing Directionally Solidified Castings", and to U.S. Pat. Nos. 3,931,847, 3,754,592, 3,810,504, and 3,519,063.

The following are additional examples of core compositions which represent the practice of this invention:

EXAMPLE 4

| | | |
|---|---|---|
| Refractory Filler | | 83.2% |
| 46.8 | 70 Mesh Fused Silica | |
| 20.6 | −325 Mesh Fused Silica | |
| 8.6 | 70 Mesh Zircon | |
| 2.9 | −325 Mesh Zircon | |
| 4.6 | 120 Mesh Alumina | |
| 1.5 | −325 Mesh Alumina | |
| 25.0 | 80–325 Mesh Cristobalite | |
| Silicone Resin | | 15.7 |
| G.E. 355 Resin | | |
| Internal Lubricant | | 0.5 |
| Calcium Stearate | | |
| Catalyst | | 0.6 |
| 50% Superfine MgO | | |
| 50% Benzoic Anhydride | | |
| | | 100.0% |

EXAMPLE 5

| | | |
|---|---|---|
| Refractory Filler | | 79.5% |
| 21.7% | −80 Mesh Fused Silica | |
| 20.0 | −100 Mesh Fused Silica | |
| 30.7 | −325 Mesh Fused Silica | |
| 6.1 | −325 Mesh Alumina Flour | |
| 11.2 | −325 Mesh Zircon Flour | |
| 10.0 | −200 Mesh Cristobalite | |
| Silicone Resin | | 19.4 |
| Dow Corning 63817 or | | |
| G.W. 355 Resins | | |
| Internal Lubricant | | 0.5 |
| Calcium Stearate | | |
| Catalyst | | 0.6 |
| 50% Superfine MgO | | |
| 50% Phthalic Anhydride | | |
| | | 100.0% |

EXAMPLE 6

| | | |
|---|---|---|
| Refractory Filler | | 79.5% |
| 67% | 70 Mesh Fused Silica | |
| 25 | −325 Mesh Fused Silica | |
| 8 | −325 Mesh Cristobalite | |
| Silicone Resin | | 19.4 |
| Dow corning 63817 or | | |
| G.E. 355 Resins | | |
| Internal Lubricant | | 0.5 |
| Calcium Stearate | | |
| Catalyst | | |
| 50% Superfine MgO | | |
| 50% Diphenic Anhydride | | |
| | | 100.0% |

EXAMPLE 7

| | | |
|---|---|---|
| Refractory Filler | | 79.5% |
| 49.8% | 70 Mesh Fused Silica | |
| 20.6 | −325 Mesh Fused Silica | |
| 8.6 | 70 Mesh Zircon | |
| 2.9 | −325 Mesh Zircon | |
| 4.6 | 120 Mesh Alumina | |
| 1.5 | −325 Mesh Alumina | |
| 1.0–10.0 | −200 Mesh Graphite, Carbon or Wood Flour | |
| 12.0 | −200 Mesh Cristobalite | |
| Silicone Resin | | 19.4 |
| Dow corning 63817 or | | |
| G.E. 355 Resins | | |
| Internal Lubricant | | 0.5 |
| Calcium Stearate | | |
| Catalyst | | 0.6 |

-continued

| | |
|---|---|
| 50% Superfine MgO | |
| 50% Benzoic Anhydride | |
| | 100.0% |

The cores are prepared and use in the manners described for Examples 1 to 3.

It will be understood that changes may be made in the details of the formulation of the core composition and in its preparation and method of use in the manufacture of cast metal parts, without departing from the spirit of the invention, especially as defined in the following claims.

We claim:

1. A ceramic core for use in the casting of hollow metal parts at temperature a in excess of 2000° F. consisting essentially of fused silica in an amount of at least 50% by weight of the core, Cristobalite in an amount within the range of 2.5–35% by weight and the remainder a ceramic material selected from the group consisting of zircon and alumina.

2. A ceramic core as claimed in claim 1 in which the Cristobalite is present in the core in an amount within the range of 5–20% by weight.

* * * * *

UNITED STATES PATENT OFFICE

CERTIFICATE OF CORRECTION

Patent No. 4,190,450 Dated February 26, 1980

Inventor(s) Ronald R. Robb, Charles Yaker & Lamar Burd

It is certified that error appears in the above-identified patent and that said Letters Patent are hereby corrected as shown below:

Col. 3, line 16, under Examples 1 to 3, change "29 39" to -- 20-30 --

Col. 4, line 47, under Example 6, across from "catalyst" insert -- 0.6 --

Col. 6, line 5, before "temperature" insert -- a --; after "temperature" cancel "a"

Signed and Sealed this

*Eighth* Day of *July 1980*

[SEAL]

*Attest:*

SIDNEY A. DIAMOND

*Attesting Officer* *Commissioner of Patents and Trademarks*